US005549501A

United States Patent [19]

Jow

[11] Patent Number: 5,549,501

[45] Date of Patent: Aug. 27, 1996

[54] TOY CAR WITH A LIFTABLE STEERING WHEEL ASSEMBLY

[75] Inventor: Jin-Long Jow, Taipei, Taiwan

[73] Assignee: Chain Fong Toys Co., Ltd., Taipei, Taiwan

[21] Appl. No.: 478,791

[22] Filed: Jun. 7, 1995

[51] Int. Cl.[6] ..... A63H 17/36

[52] U.S. Cl. ..... 446/460; 446/466; 446/468; 446/462; 446/484

[58] Field of Search ..... 446/460, 461, 446/468, 466

[56] References Cited

U.S. PATENT DOCUMENTS

| | | | |
|---|---|---|---|
| 2,096,333 | 10/1937 | Marx | 446/460 |
| 2,618,101 | 11/1952 | Berger | 446/460 |
| 2,770,074 | 11/1956 | Jones . | |
| 3,517,458 | 6/1970 | Sato . | |
| 3,871,129 | 3/1975 | Tong | 446/460 |

*Primary Examiner*—Mickey Yu
*Assistant Examiner*—Jeffrey D. Carlson
*Attorney, Agent, or Firm*—Jacobson, Price, Holman & Stern, PLLC

[57] ABSTRACT

A toy car including a casing mounted inside the car body to hold a driving mechanism and a transmission mechanism, a steering wheel assembly mounted in a circular opening on the chassis and coupled to the transmission mechanism, a battery power supply mounted on the chassis, a stop member mounted on the chassis, a link coupled between an upright shaft on the steering wheel assembly and the transmission mechanism and having a front downward rod, a slide having one end coupled to the link and an opposite end terminating in two retainer arms engaging the stop member, and a switch disposed in a side opening on the slide, wherein when the toy car is depressed by the player against the ground, the steering wheel assembly is lifted to tilt the link, causing the front downward rod of the link forced into a locating hole on the slide for permitting the slide to be moved by the link to switch off the switch in cutting off battery power supply from the driving mechanism.

4 Claims, 5 Drawing Sheets

TOY CAR WITH A LIFTABLE STEERING WHEEL ASSEMBLY

BACKGROUND OF THE INVENTION

The present invention relates to a toy car which comprises a link Coupled between the transmission mechanism and the steering wheel assembly, and a slide coupled between the link and a stop member on the chassis of the toy car, wherein when the toy car is depressed by the player against the ground, the steering wheel assembly is lifted to tilt the link, causing a front downward rod of the link to be forced into a locating hole on the slide for permitting the slide to be moved by the link to switch off a switch and cut off battery power supply from the driving mechanism.

A regular toy car is generally comprised of a car body supported on wheels, a battery box mounted on the chassis of the car body to hold a battery, a motor drive, a steering wheel assembly, and a transmission mechanism coupled between the motor drive and the steering wheel assembly. When the motor drive is turned on, the steering wheel assembly is driven by the transmission mechanism to move the car body. This structure of toy car is still not satisfactory in function. Because the steering wheel assembly is fixed in place and cannot be lifted relative to the chassis of the car body, the motor drive will be damaged due to an overload when the toy car is forced downward against the ground by a child.

SUMMARY OF THE INVENTION

The present invention has been accomplished to provide a toy car with a liftable steering wheel assembly which eliminates the aforesaid drawbacks. According to one aspect of the present invention, the toy car comprises a casing mounted inside the car body to hold a driving mechanism and a transmission mechanism, a steering wheel assembly mounted in a circular opening on the chassis and coupled to the transmission mechanism, a battery power supply mounted on the chassis, a stop member mounted on the chassis, a link coupled between an upright shaft on the steering wheel assembly and the transmission mechanism and having a front downward rod, a slide having one end coupled to the link and an opposite end terminating in two retainer arms respectively engaging two opposite curved side walls of the stop member, and a switch disposed in a side opening on the slide, wherein when the toy car is depressed by the player against the ground, the steering wheel assembly is lifted to tilt the link, causing the front downward rod of the link to be forced into a locating hole on the slide for permitting the slide to be moved by the link to switch off the switch and cut off battery power supply from the driving mechanism.

According to another aspect of the present invention, the locating hole of the slide is situated in a funnel-shaped orifice for guiding the downward rod of the link into or out of the locating hole of the slide.

According to still another aspect of the present invention, the retainer arms of the slide have a respective front end terminating in a respective inward hook, which defines an inside recessed surface, which engages one curved side wall of the stop member. When the slide is moved by the link, the hooks of the retainer arms moved along the two opposite curved side walls of the stop member between two opposite ends thereof.

DETAILED DESCRIPTION OF THE PREFERRED EMBODIMENT

Figure 1:
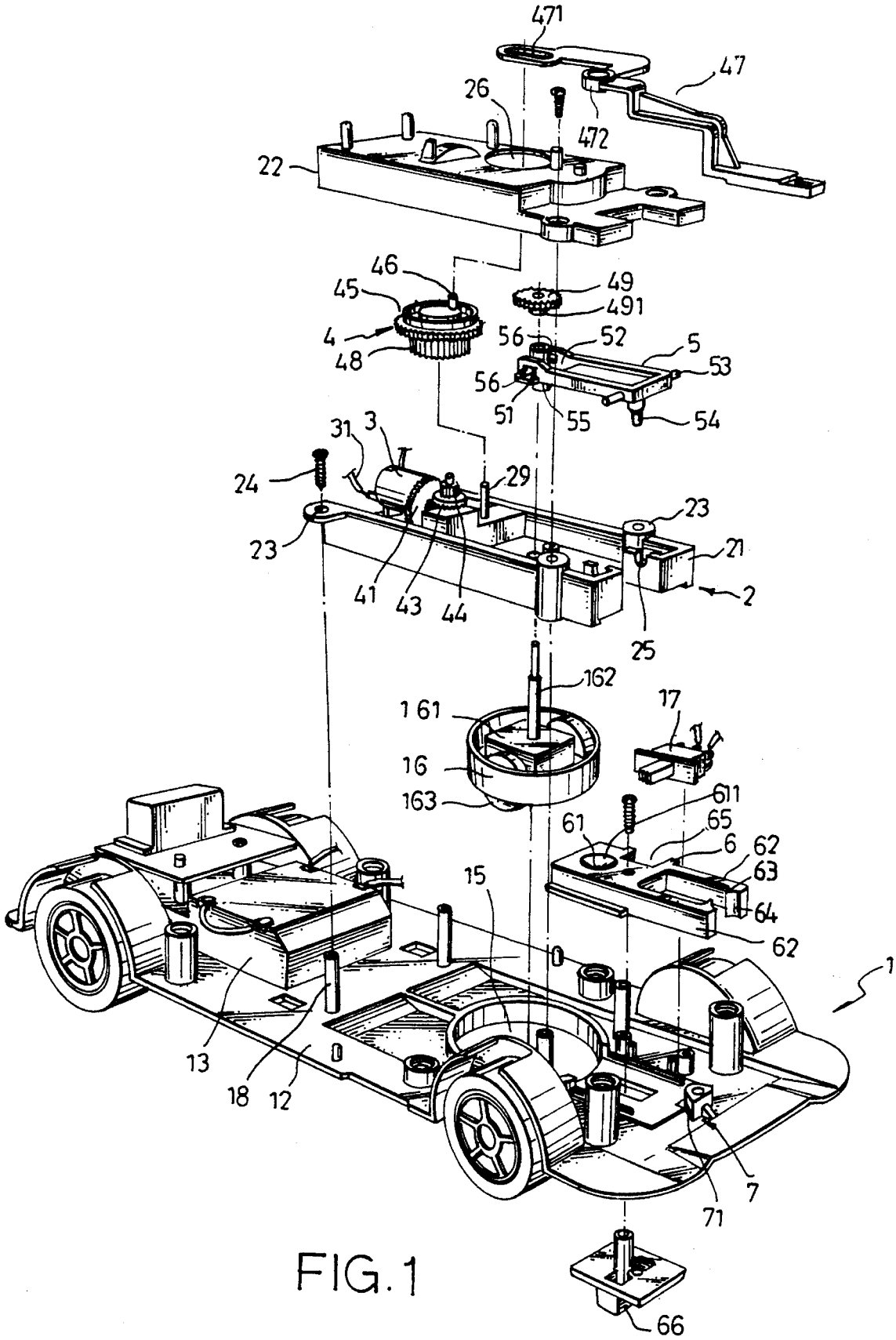
FIG. 1 is an exploded view of a toy car according to the present invention.
Figure 2:
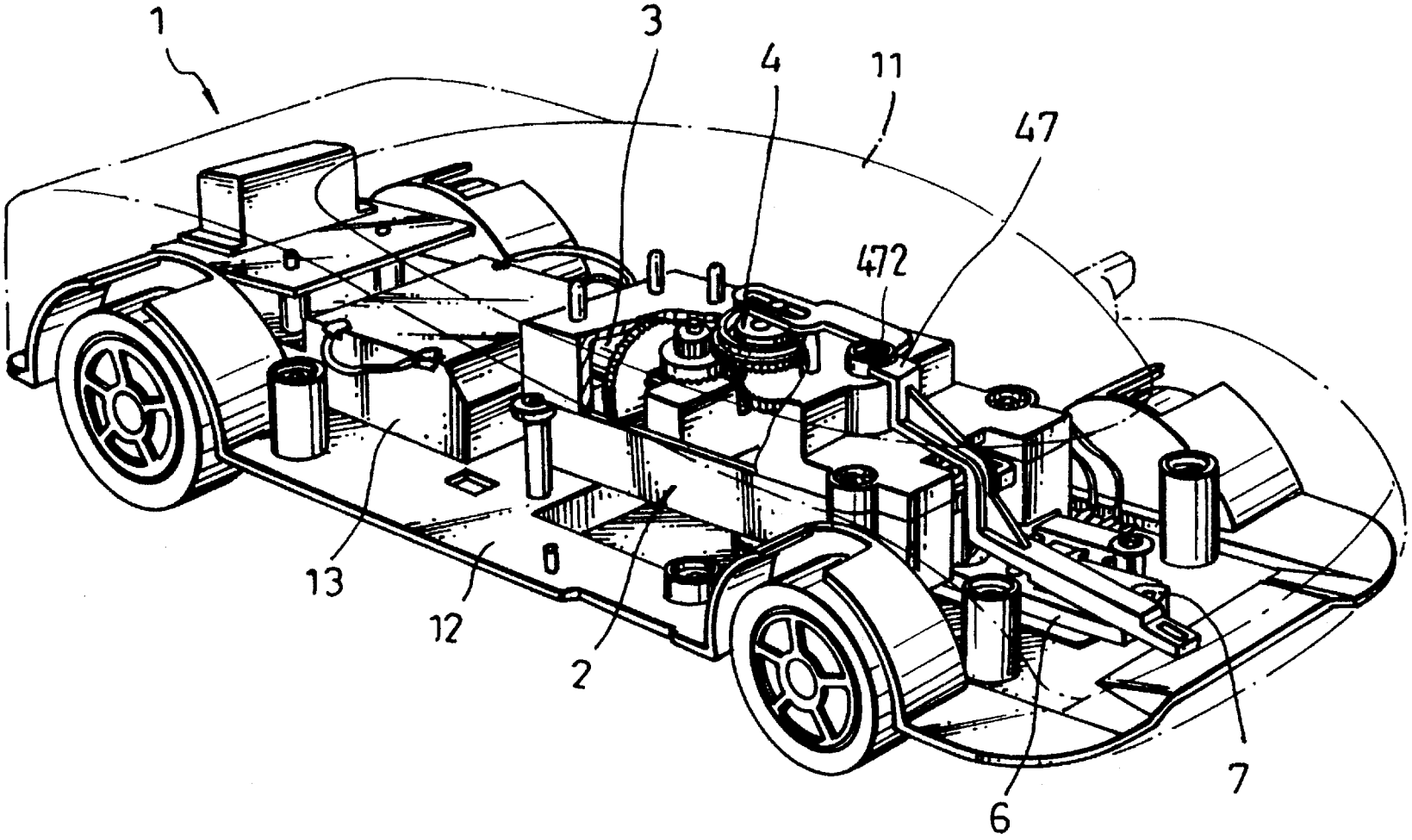
FIG. 2 is a perspective view of the toy car shown in FIG. 1.
Figure 3:
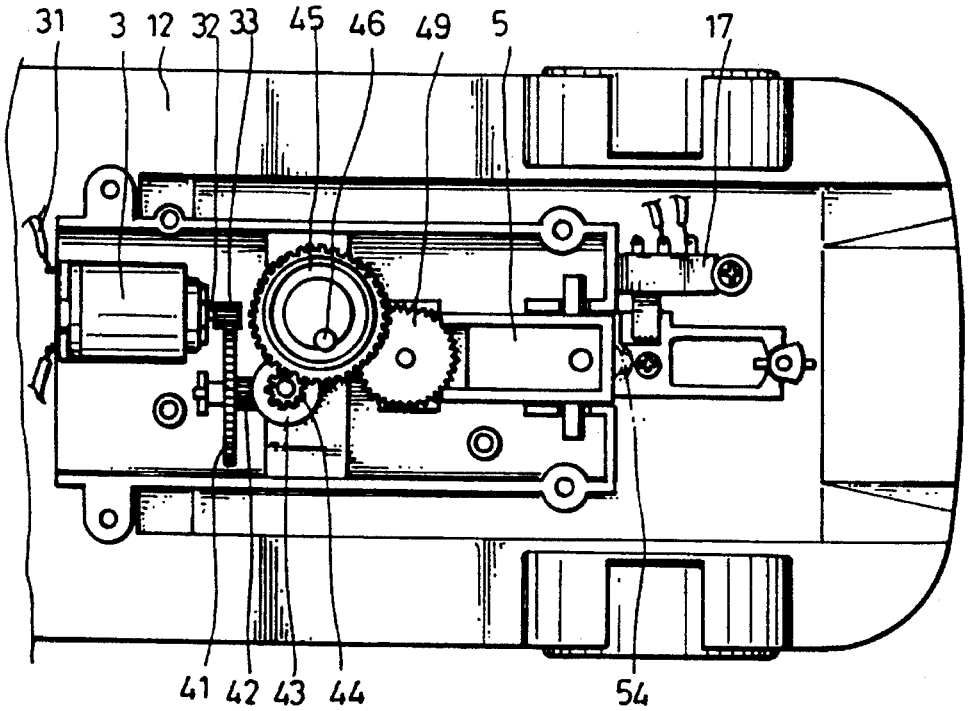
FIG. 3 is a top plain view of FIG. 2.
Figure 4A:
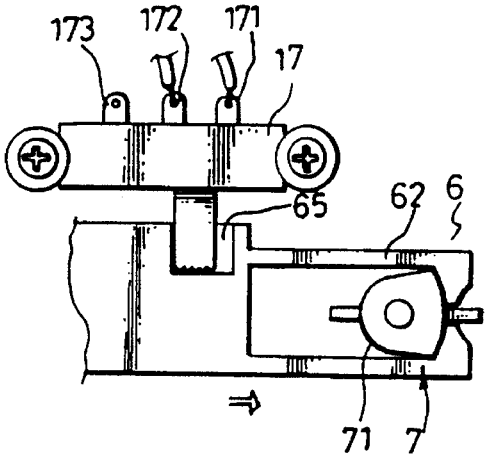
FIG. 4A shows the retainer arms of the slide moved into engagement with the bigger rear end of the stop member according to the present invention.
Figure 4B:
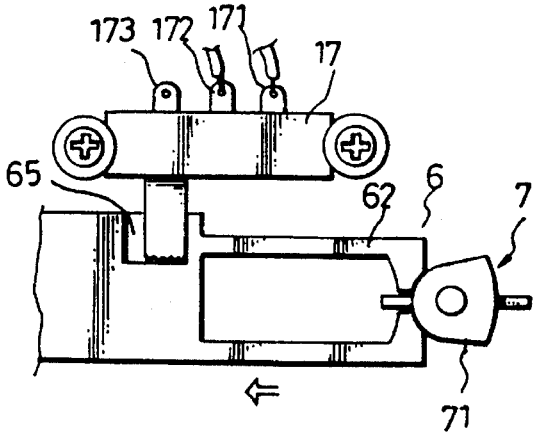
FIG. 4B shows the retainer arms of the slide moved into engagement with the smaller front end of the stop member according to the present invention.
Figure 5A:
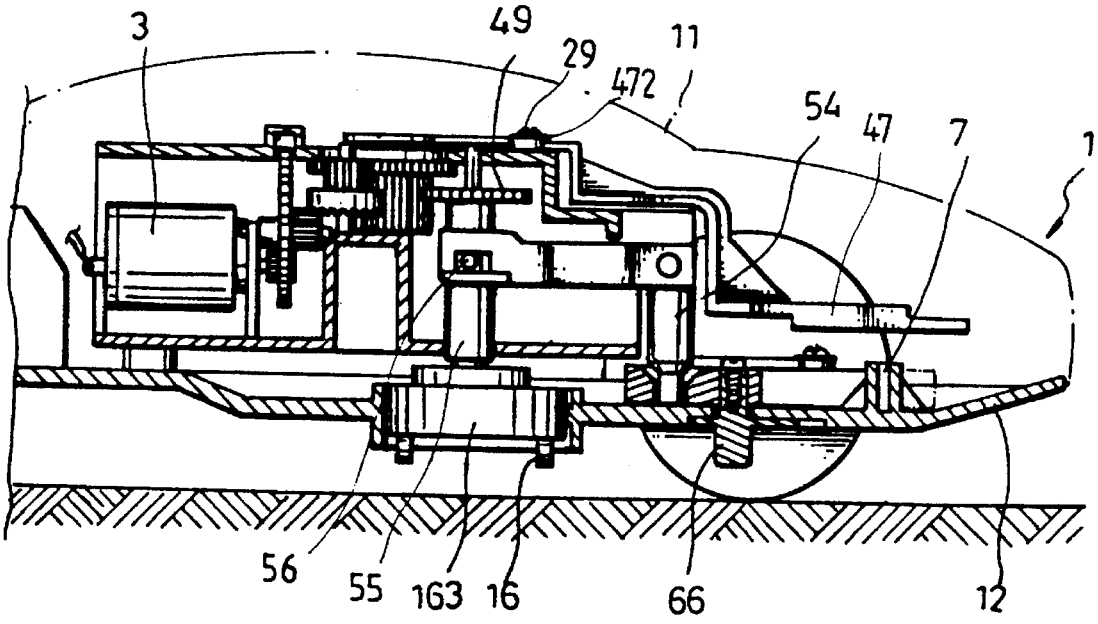
FIG. 5A is a side view in section of the toy car shown in FIG. 2, showing the steering wheel assembly received back inside the circular opening on the chassis.
Figure 5B:
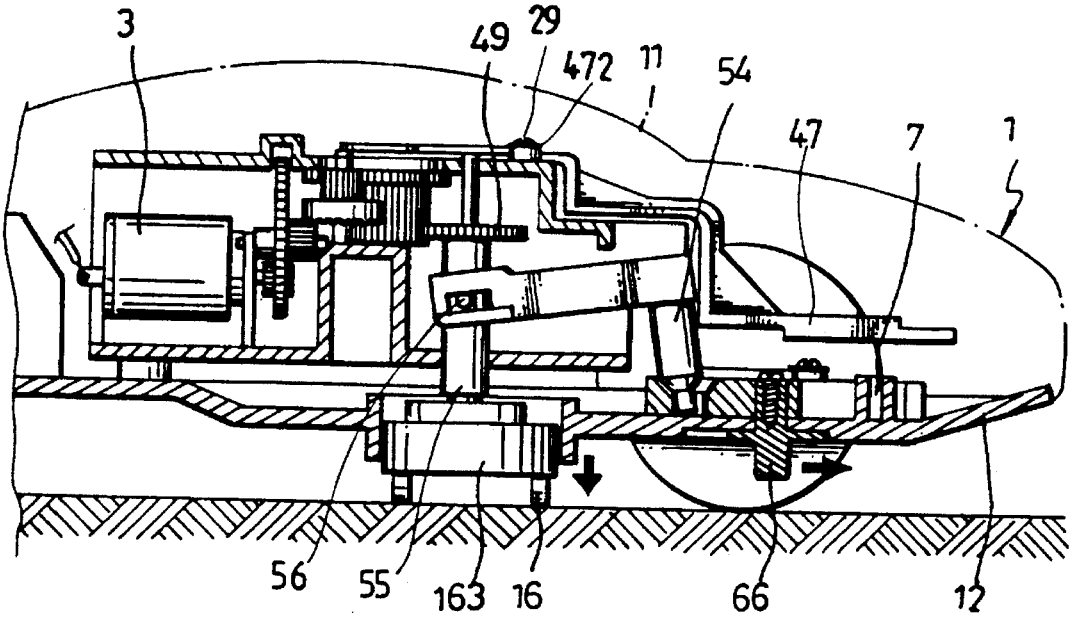
FIG. 5B is similar to FIG. 5A but showing the steering wheel assembly extended out of the chassis.
Figure 6:
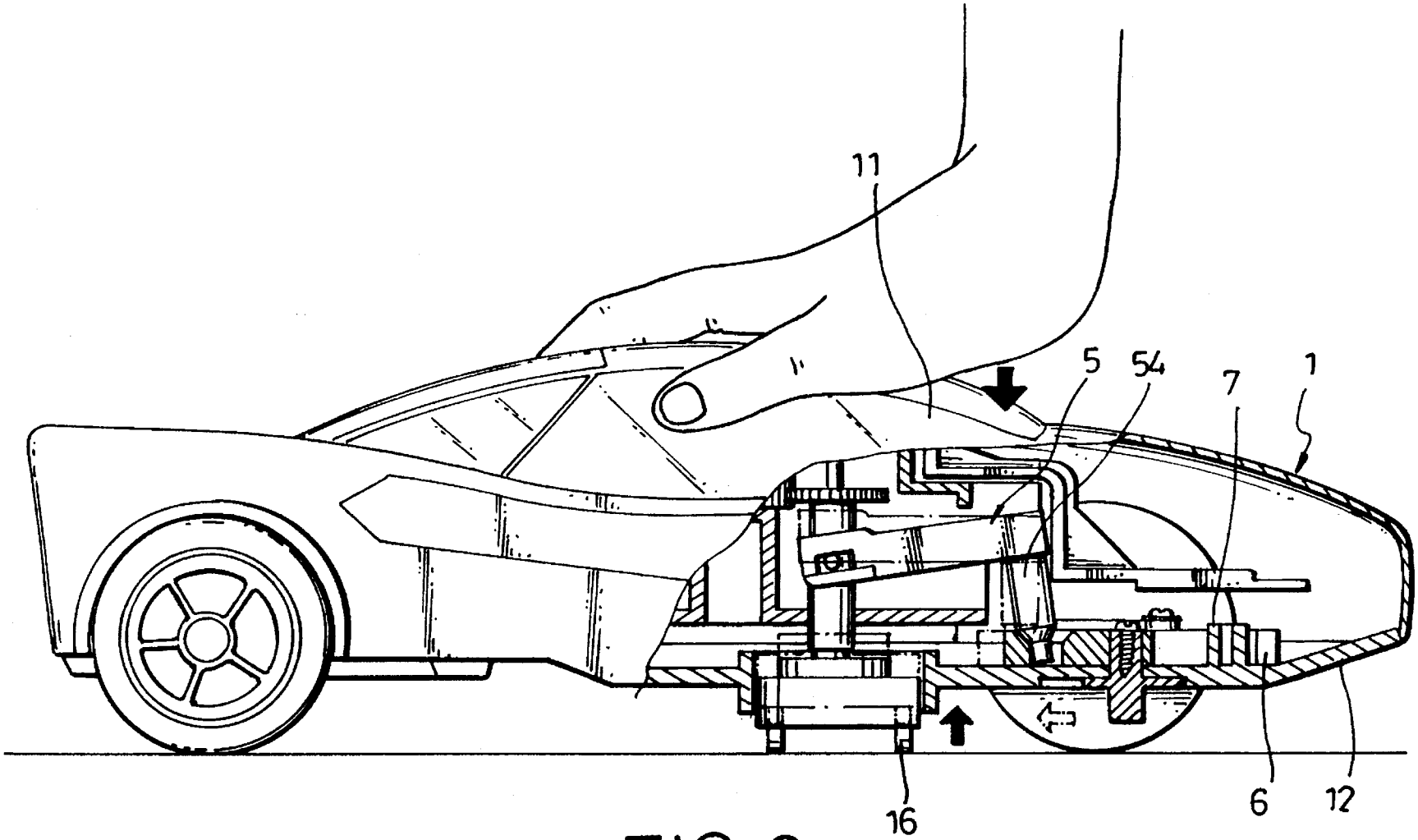
FIG. 6 shows the toy car forced downward against the ground and the steering wheel assembly lifted according to the present invention.

Referring to FIGS. 1, 2, 3, 4A, 4B, 5A, 5B, and 6, a toy car in accordance with the present invention is generally comprised of a car body 1, a casing 2, a driving mechanism 3, a transmission mechanism 4, a link 5, a slide 6, and a stop member 7.

The car body 1 comprises a shell 11, which can be made in the shape of any of a variety of real cars, a chassis 12 fixedly secured to the shell 11 at the bottom, a battery holder 13 mounted on the chassis 12 at the top near one end to hold a battery, a circular opening 15 in front of the battery holder 13, a steering wheel assembly 16 mounted within the circular opening 15, and a switch 17 mounted on the chassis 12 adjacent to the casing 2, which is mounted on the chassis 12 around the circular opening 15, remote from the battery holder 13. The steering wheel assembly 16 comprises a block 161 at the center, an upright shaft 162 raised from the block 161, and two steering wheels 163 mounted on two opposite sides of the block 161 and projecting from the bottom of the chassis 12.

The casing 2 comprises a base frame 21 fixedly secured to the chassis 12 around the circular opening 15, and a cover frame 22 covering the base frame 21. The cover frame 22 has an opening 26 for passing the eccentric shaft 46 of the transmission mechanism 4. The base frame 21 comprises a plurality of lugs 23 respectively fastened to respective upright posts 18 on the chassis 12 by a respective screw 24. The driving mechanism 3 and the transmission mechanism 4 are respectively mounted on the base frame 21. The link 5 is connected to the transmission mechanism 4 and driven by the driving mechanism 3 through the transmission mechanism 4, having a downward rod 54 coupled to the slide 6, which is mounted on the chassis 12 adjacent to the switch 17.

The driving mechanism 3 is mounted on the base frame 21 of the casing 2 and electrically connected to the battery holder 13 and the switch 17 by an electric wire 31. The switch 17 has three contacts, namely, the first contact 171, the second contact 172, and the third contact 173. The first contact 171 and the second contact 172 are respectively connected to the two opposite terminals of the battery holder 13. The driving mechanism 3 comprises an output shaft 32, and a pinion 33 fixedly mounted around the output shaft 32 and meshed with the transmission mechanism 4.

The transmission mechanism 4 comprises a first transmission gear 41 meshed with the pinion 33 of the driving mechanism 3, a coaxial gear 42 fixedly secured to the first transmission gear 41 at one side, a second transmission gear 43 meshed with the coaxial gear 42 and turned about a shaft (not shown) on the base frame 21 of the casing 2, a small gear 44 fixedly mounted on the second transmission gear 43, a third transmission gear 45 mounted on the base frame 21 on a shaft and meshed with the small gear 44, an eccentric shaft 46 raised from the third transmission gear 45 at one side and projecting out of the opening 26 on the cover frame 22, a crank 47 pivotably mounted on the cover frame 22 on the outside by a screw 29 inserted in hub 472 (FIGS. 5A and 5B) and having a sliding slot 471 at one end coupled to the eccentric shaft 46, a gear 48 fixedly secured to the third transmission gear 45 at an opposite side relative to the eccentric shaft 46, a driven gear 49 mounted around the upright shaft 162 of the steering wheel assembly 16 and meshed with the gear 48 and having a collar 491 at one side with pins which locate gear 49 to shaft 162.

The link 5 comprises a recessed seat 52 at a rear end thereof, with a sleeve 55 which receives the shaft 162, two pin holes 51 aligned at two opposite sides of the recessed seat 52 and respectively receiving pins 56 on sleeve 55, two opposite pivot pins 53 at a front end thereof respectively fastened to respective mounting grooves 25 on the base frame 21 of the casing 2, and a downward rod 54 extended from the middle of the front end and inserted into a locating hole 61 on the slide 6.

The slide 6 comprises the locating hole 61 at one end coupled to the downward rod 54 of the link 5, two parallel retainer arms 62 at an opposite end fastened to the stop member 7, a side opening 65 at one side, which receives the switch 17, and a downward knob 66 extended out of the bottom side of the chassis 12. The locating hole 61 is situated in a funnel-shaped orifice 611 through which the downward rod 54 can be conveniently inserted into the locating hole 61. The retainer arms 62 have a respective front end terminating in a respective inward hook 63, which defines an inside recessed surface 64, which engages one side of the stop member 7.

The stop member 7 is a generally bell-shaped block mounted on the chassis 12, having two curved side walls 71 extended outwardly backwards from a smaller front end thereof toward a bigger rear end thereof. When the slide 6 is moved by the link 5, the hooks 63 of the retainer arms 62 of the slide 6 are respectively moved along the curved side walls 71 into engagement with the bigger rear end of the stop member 7, for permitting the switch 17 to be moved by the slide 6 to turn on the driving mechanism 3.

The operation of the toy car is outlined hereinafter with reference to FIGS. 3, 4A, 4B, 5A, and 5B again. When the knob 66 is moved manually to the right (FIG. 4A), the slide 6 is moved, causing the hooks 63 of the retainer arms 62 of the slide 6 respectively moved along the curved side walls 71 into engagement with the bigger rear end of the stop member 7, and at the same time the downward rod 54 of the link 5 is forced out of the locating hole 61 of the slide 6. When the downward rod 54 of the link 5 is forced out of the locating hole 61 of the slide 6, the link 5 is tilted to force upright shaft 162 downwards, through sleeve 55 causing the steering wheel assembly 16 to move out of the bottom side of the chassis 12 (see FIG. 5B). At the same time, the switch 17 is forced by the slide 6 to disconnect the third contact 173 and the second contact 172 and to connect the second contact and the first contact, permitting battery power supply to be transmitted from the battery holder 13 to the driving mechanism 3 through the first contact 171 and the second contact 172 (see FIGS. 4A and 4B). When the driving mechanism 3 is turned on to rotate the pinion 33, the first transmission gear 41 is driven to rotate the driven gear 49 through the second transmission gear 43 and the third transmission gear 45, causing the driven gear 49 to rotate the upright shaft 162 of the steering wheel assembly 16 causing the wheel 163 to rotate. The free end crank 47 opposite slot 471 is used to set the position of steering wheels because the eccentric shaft 46 of the third transmission gear 45 is coupled to the sliding slot 471 of the crank 47, so that the steering wheels 163 of the steering wheel assembly 16 make a linear motion when the crank is straight ahead or will steer to the left or right when the crank is pivoted correspondingly. On the contrary, when the knob 66 is moved manually in the reversed, direction, (FIG. 4B) the hooks 63 of the retainer arms 62 of the slide 6 are respectively moved along the curved side walls 71 into engagement with the smaller front end of the stop member 7, and at the same time the switch 17 is forced by the slide 6 to disconnect the the second contact 172 and the first contact 171 and to connect the second contact 17 and the third contact 173, causing battery power supply cut off from the driving mechanism 3, and therefore the driving mechanism 3 is stopped.

Referring to FIGS. 4A, 4B, and 6 again, when the car body 1 is pressed downwards by the player against the ground, the steering wheel assembly 16 is forced back into the circular opening 15 on the chassis 12. When the steering wheel assembly 16 is forced into the circular opening 15, the front end of the link 5 is moved upwards by the upright shaft 162 of the steering wheel assembly 16, causing the downward rod 54 guided by the funnel-shaped orifice 611 into the locating hole 61 on the slide 6 (see FIG. 6). When the downward rod 54 of the link 5 is forced into the locating hole 61 on the slide 6, the slide 6 is then moved backwards by the link 5, causing the hooks 63 of the retainer arms 62 respectively moved from the bigger rear end of the stop member 7 along the curved side walls 71 into engagement with the smaller front end of the stop member 7, and at the same time the switch 17 is switched off to disconnect the driving mechanism 4 from the battery holder 13 (see FIGS. 4A and 4B) to stop the transmission mechanism 4, therefore, the driving mechanism 3 and the transmission mechanism 4 will not be damaged when the steering wheel assembly 16 is pressed downward against the ground.

It is to be understood that the drawings are designed for purposes of illustration only, and are not intended as a definition of the limits and scope of the invention disclosed.

I claim:

1. A toy car of the type comprising a car body having a chassis, a casing mounted on said chassis, a driving mechanism mounted inside said casing, a transmission mechanism mounted inside said casing and driven by said driving mechanism and having a driven gear for power output, a steering wheel assembly mounted in a circular opening on said chassis and having an upright shaft at a top side coupled to said driven gear of transmission mechanism and two steering wheels at a bottom side for the steering control, a battery power supply mounted on said chassis, and a switch mounted on said chassis and connected between said battery power supply and said driving mechanism, the improvement comprising:

a link mounted on said casing and coupled to a sleeve surrounding said upright shaft between said steering wheel assembly and said transmission mechanism, said link comprising two pin holes bilaterally disposed at one end thereof and coupled to respective pins on the sleeve, two opposite pivot pins bilaterally disposed at an opposite end thereof and fastened to respective mounting grooves on said casing, and a downward rod extended from said opposite end; a slide with a locating hole which receives said rod said slide coupled to said link and movable to switch said switch, said locating hole receiving the downward rod of said link when said steering wheel assembly is forced to move said upright shaft upward so as to lift said link, said slide having two parallel retainer arms at an end opposite the locating hole fastened to a stop member and a slide opening at one side, which receives said switch; and said stop member being mounted on said chassis and receiving the retainer arms of said slide, said stop member having a smaller front end facing said slide, a bigger rear end, two curved side walls extended outwardly backwards from said smaller front end toward said bigger rear end.

2. The toy car of claim 1 wherein the locating hole of said slide is located in a funnel-shaped orifice for guiding the downward rod of said link into and out of the locating hole of said slide.

3. The toy car of claim 1 wherein the retainer arms of said slide have a respective front end terminating in a respective inward hook, which defines an inside recessed surface, which engages each respective curved side wall of said stop member.

4. The toy car of claim 1 wherein said slide further comprises a downward knob extended out of said chassis for moving by hand.

* * * * *